United States Patent [19]

Steffen

[11] 4,319,411

[45] Mar. 16, 1982

[54] ASPIRATING PANEL FOR GRAIN BINS

[76] Inventor: Vincent B. Steffen, 3 N. Walnut Ave., New Hampton, Iowa 50659

[21] Appl. No.: 194,253

[22] Filed: Oct. 6, 1980

[51] Int. Cl.[3] ..... F26B 9/02

[52] U.S. Cl. ..... 34/233; 34/174; 34/225; 98/55

[58] Field of Search ..... 34/174, 233, 225; 98/55; 52/302, 303, 192, 245

[56] References Cited

U.S. PATENT DOCUMENTS

| | | | |
|---|---|---|---|
| 3,092,472 | 6/1963 | Figley | 34/174 |
| 4,009,520 | 3/1977 | Sukvp | 98/55 |
| 4,053,991 | 10/1977 | Steffen | 34/233 |

*Primary Examiner*—Larry I. Schwartz
*Attorney, Agent, or Firm*—Henderson & Sturm

[57] ABSTRACT

In the field of grain ventilation, grain bins are constructed to allow air circulation from a plenum chamber through the grain floor and the grain to an exhaust. The invention relates to a panel for improving grain bin design so as to more effectively practice grain ventilation.

An aspirating panel is formed to include a cylindrically shaped rib along both its longer sides. In constructing a grain bin floor, sidewall, or roof, panels are fastened together such that a slit remains between the ribs of adjacent panels. The slit allows air freely to pass through. In the case of a sidewall or roof, the panel design allows the wind to aspirate air from inside the grain bin by creating low pressure regions near the slits which enhance air exhaustion.

6 Claims, 13 Drawing Figures

ASPIRATING PANEL FOR GRAIN BINS

DESCRIPTION

1. Technical Field

My invention relates to the roofs, sidewalls and floors of grain bins, and, more particularly, to the panels which are fastened together to form an entire roof, wall or floor of a grain bin.

Grain ventilation is increasingly becoming the acceptable means of preserving grain during storage. To practice grain ventilation, a grain storage bin must have an air intake means and an air exhaust means. My invention relates to a grain bin floor which allows air to pass through it as a necessary component of an air intake means and an aspirating roof or sidewall which relies on the wind to encourage air exhaustion.

2. Background Art

The prior art of U.S. Pat. No. 4,004,352 provided for a grain bin having a roof, a perforated floor, a grain storage chamber above the floor, a plenum chamber below the floor and a fan for forcing air into the plenum chamber, through the floor, through the grain storage chamber and ultimately out a relatively small turbine exhaust structure located at the roof apex. U.S. Pat. No. 4,020,565 improved on the prior art by showing that an entire roof may consist of a rotatable turbine. More recently, U.S. patent application Ser. No. 950,785 now U.S. Pat. No. 4,256,029, taught the use of a fan design for the roof or upper portion of the bin different from the fan design for the plenum chamber in order to create a push-pull grain ventilation system.

SUMMARY OF INVENTION

With the present invention, I provide a much simpler air exhaust system than U.S. Pat. No. 4,020,565, a more efficient system than U.S. Pat. No. 4,004,352, and, in terms of expenditures for energy, a less costly system than U.S. patent application Ser. No. 950,785.

In accordance with the present invention, I provide for a metallic panel which may be used to construct a grain bin roof, sidewall, or floor. Along the two longer sides of each panel, a cylindrically shaped ribbing is formed. Along the center of the ribbing, holes are drilled to provide for fastening the panels together. The holes in the left rib of each panel are countersunk downward, while the holes in the right rib are countersunk upward. Thus, when panels are laid adjacent to one another and bolted together, they are separated vertically by a distance equal to twice the height of the countersunk conical wall. As a result, a completed roof or sidewall has a number of radial slits in it. As the wind blows past the grain bin, and more particularly past a slit, the wind creates a low pressure region at the slit which causes air inside the bin to move toward and out the slit. Thus, the roof or sidewall aspirates, or, in other words, accomplishes the air exhaustion aspect of a grain bin ventilation system.

A grain bin floor may similarly be constructed from aspirating panels. As opposed to aspirating like a roof or sidewall, however, the floor ventilates, allowing air to pass from the building plenum chamber into the grain bin without allowing grain to pass therethrough.

BRIEF DESCRIPTION OF DRAWINGS

The details of my invention will be explained with reference to the accompanying drawings, in which.

DESCRIPTION OF THE PREFERRED EMBODIMENTS

Figure 1:
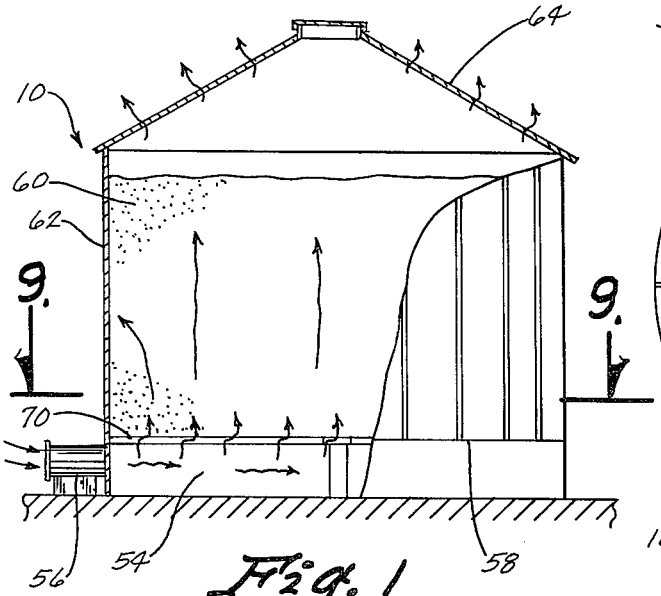
FIG. 1 is a front, partial cross-sectional view of a grain bin.

Referring now to the drawings, FIG. 1 shows a typical grain bin 10 used for ventilating and, consequently, preserving grain. The introduction of air and its circulation from the plenum chamber through the grain to an exhaust port is described in U.S. Pat. No. 4,004,352. The present invention relates to the panels which may be used for the floor, walls and roof of a grain ventilation grain bin, and the resulting improvement to such bin if they are used in its construction.

Figure 2:
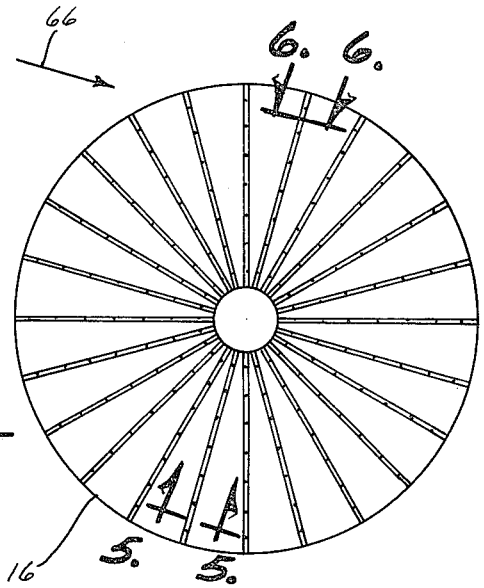
FIG. 2 is a top view of a grain bin.
Figure 3:
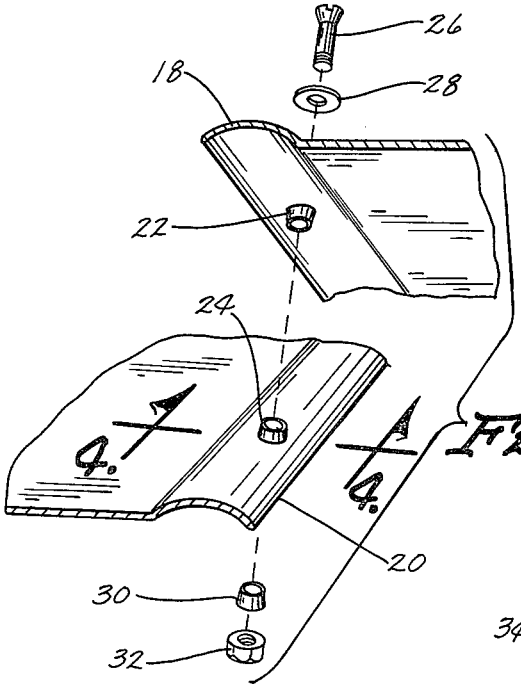
FIG. 3 is an exploded view of portions of two adjacent panels and the required fastening elements.
Figure 4:
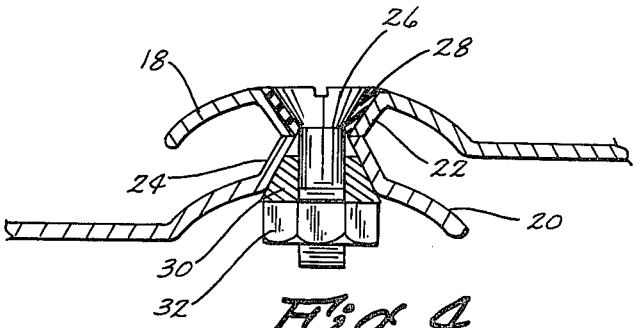
FIG. 4 is a cross-sectional view of a fastening joint.
Figure 9:
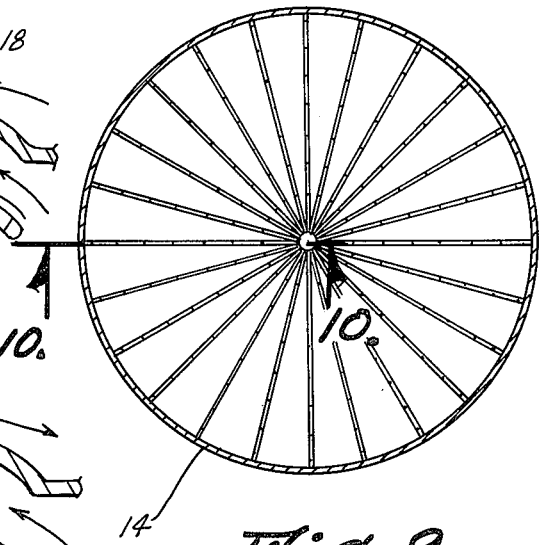
FIG. 9 is a cross-sectional view of the floor of a grain bin taken along line 9—9 of FIG. 1.

A wall panel 12 is rectangularly shaped, while floor panels 14 (FIG. 9) and roof panels 16 (FIG. 2) are trapezoidal in shape. Referring to FIG. 3, each panel has a first rib 18 along the left longer edge and a second rib 20 along the right longer edge. Although the panel ribbing may be formed in various shapes, a cylindrical shape is the best mode. The bolt holes used for fastening adjacent panels together are centered on each rib. Each hole 22 in the first rib 18 is countersunk inwardly while each hole 24 in the second rib 20 is countersunk outwardly. Adjacent panels are fastened together with a screw 26, a resilient washer 28, a pre-formed washer 30, and a nut 32. FIG. 4 shows a cross-section of an assembled fastening joint. Note that the left-most panel 20 is separated from and positioned below the right-most panel 18 a distance equal to the wall height of countersunk holes 22 and 24 added together.

Figure 7:
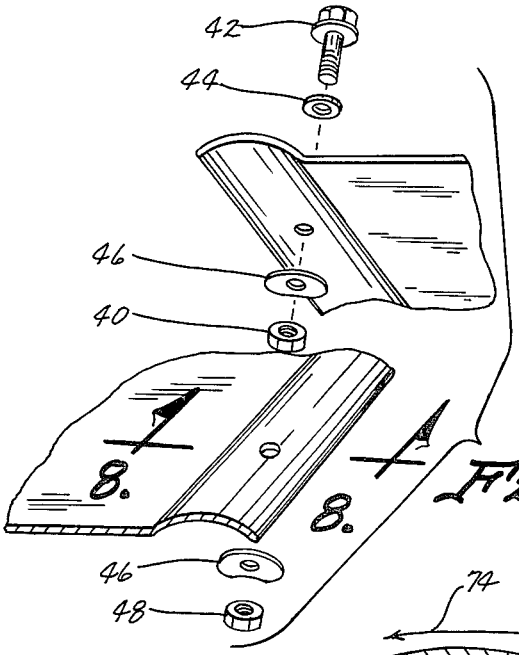
FIG. 7 is an exploded view of portions of two adjacent panels and the required fastening elements of an alternate mode for carrying out the invention to that shown in FIG. 3.
Figure 8:
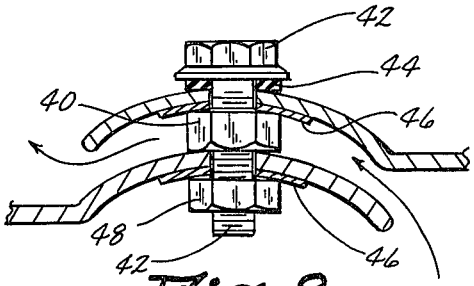
FIG. 8 is a cross-sectional view of an alternate joint mode.

Alternatively, as shown in FIG. 7, the panel rib bolt holes need not be countersunk; rather, spacer 48 may be used to keep the adjacent panels separated. The fastening joint is then completed using a bolt 42, washers 44 and 46 and nuts 48. FIG. 8 shows a cross-section of a completed joint.

Figure 10:
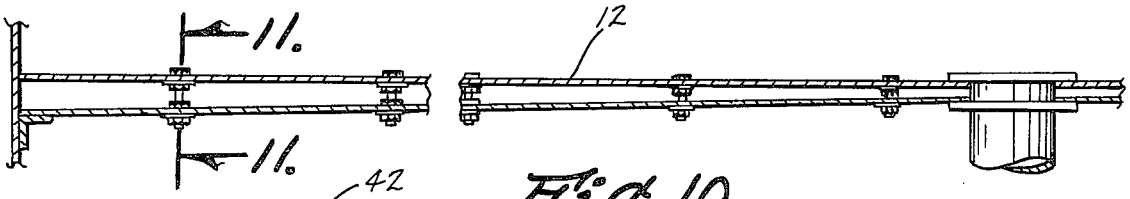
FIG. 10 is a broken cross-sectional view of the floor taken along line 10—10 in FIG. 9.
Figure 11:
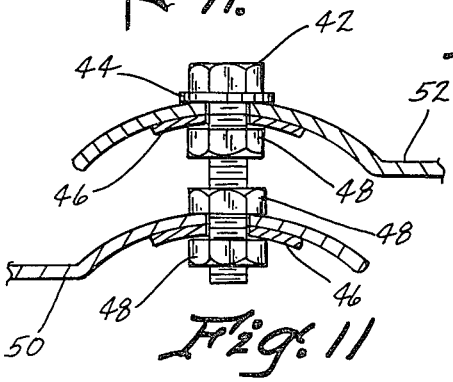
FIG. 11 is a cross-sectional view of a floor fastening connection, taken along line 11—11 of FIG. 10.

A second alternative, as shown in FIG. 10 with a fastening joint cross-section shown in FIG. 11, uses two nuts as a variable spacing mechanism. That is, bolt 42 is inserted downward, in sequence, through washer 44, right-most panel 52, and washer 46. First nut 48 is then tightened from below against washer 46. Second nut 48 is then threaded up bolt 42 a suitable distance to provide the desired separation between floor panels 50 and 52. Bolt 42 is next inserted through left-most panel 50 and washer 46, and third nut 48 is threaded up bolt 42 and tightened against washer 46 to complete the fastening joint. This fastening joint is most useful for constructing the floor.

Since the slits between adjacent panels extend radially from the center of the grain bin building to the outer wall, ordinarily, there would be more slit cross-sectional area per unit area of floor near the center of the building than near the outer wall. Hence, more of the plenum air would enter the grain bin near the center than near the outer wall. The described second fastening joint alternative provides a means to vary the spacing from the center of the grain bin to the outer walls so as to better equalize the slit cross-sectional area per unit area of floor.

The grain ventilation process, fully described in U.S. Pat. No. 4,045,878 and especially useable with my present invention, related to air drawn from outside a grain bin into a plenum chamber 54 (see FIG. 1) by fan means 56. The air leaves the plenum chamber and passes through the floor 58, as previously described, and into the grain 60. From there, the air may pass through the bin sidewall or roof. If there is no outside wind, a grain bin constructed using my invention simply allows the air to exhaust through the sidewall 62 and roof 64. If there is an outside wind, air will be drawn toward and through the sidewall and roof due to an effect called aspiration, to be explained presently.

Figure 5:
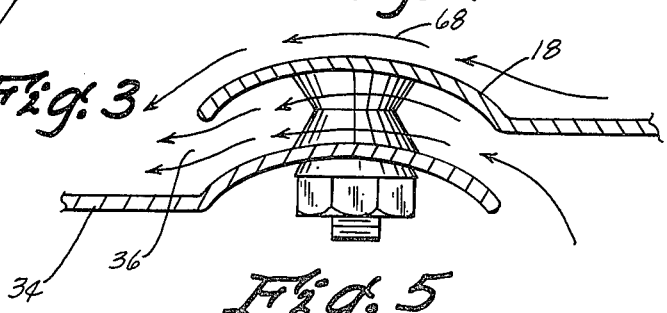
FIG. 5 is a cross-sectional view taken along line 5—5 in FIG. 2, it depicts the aspirating action under the most efficient conditions.

Regardless of the direction from which the wind is blowing, it will pass over each slit in the roof and sidewall at a different angle. Assuming the wind 66 is blowing from the direction shown in FIG. 2, it will pass by the slits shown in cross-section in FIGS. 5 and 6 as indicated. Referring to FIG. 5, the wind is depicted by a streamline 68 traveling across rib 18 and down along left-most panel 34. A low pressure region will be created near the slit 36 causing air inside the grain bin to be drawn toward and out the slit.

Figure 6:
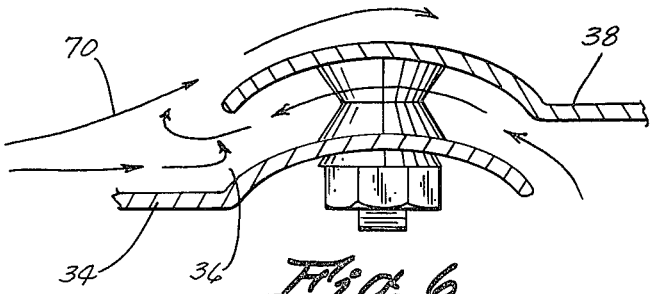
FIG. 6 is a cross-sectional view taken along line 6—6 in FIG. 2, it depicts the aspirating action under the least efficient conditions.

FIG. 6, in like manner, depicts the aspirating action on the opposite side of the building from FIG. 5. The wind in FIG. 6 is depicted by streamline 70. The wind will pass from the left-most panel 34 over the right-most panel rib 38. Although not as much air from inside the grain bin will be drawn by the aspirating action as in the FIG. 5 situation, inside air will pass through the slit 36 and into the wind stream.

Figure 12:
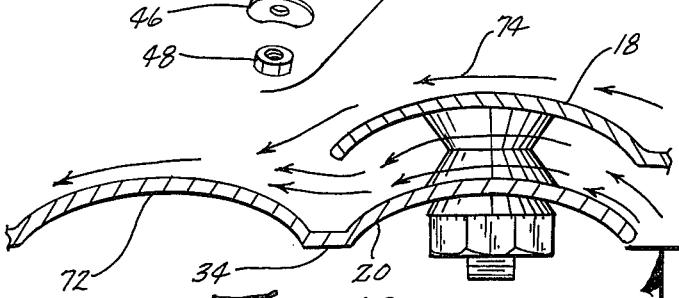
FIG. 12 depicts the aspirating action under the most efficient conditions of an alternate mode for carrying out the invention in a view like that of FIG. 5.
Figure 13:
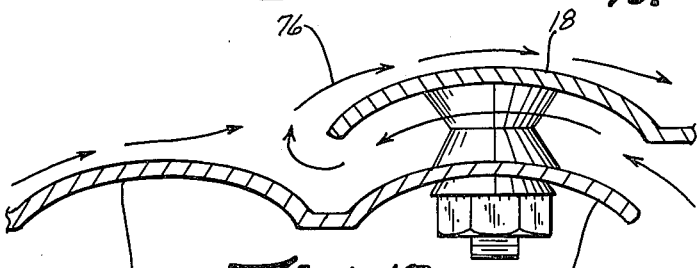
FIG. 13 depicts the aspirating action under the least efficient conditions of the alternate mode shown in FIG. 12.

An alternative aspirating panel ribbing configuration is shown in FIGS. 12 and 13. Referring to FIG. 12, a third panel rib 72 is formed adjacent to and parallel with the second panel rib 20 along the right longer edge of panel 34. With two panels having this alternative ribbing configuration fastened together, the aspiration effect works similar to the description given in conjunction with FIGS. 5 and 6. In FIG. 5, however, the slit between ribs 18 and 20 is vertically oriented leaving a triangular area wherein the slit forms the vertical leg of the triangle and a portion of streamline 68 forms the hypotenuse. Turbulence occurs in this triangular region due to the sharp discontinuity between the shapes of the panel surfaces and results in a theoretically reduced aspirational effect. In the configuration depicted in FIG. 12, rib 72 is located so as to substantially reduce the effective vertical length of the slit due to the wind-blocking effect of the additional rib 72. This results in a sizeable reduction in the turbulence region from that in the FIG. 5 configuration, and accordingly, the aspirational effect is enhanced.

A similar discussion pertains to the situation when the wind is coming from the other direction as shown in FIGS. 6 and 13. In this case, however, the FIG. 13 configuration proves to be significantly more efficient than the FIG. 6 configuration. As shown in FIG. 6, outside air may actually pass into the grain bin under some conditions. Regarding FIG. 13, on the other hand, the wind streamline 76 follows a trajectory almost identical to the wind streamline 74 in FIG. 12 with the result that both sides of the grain bin building aspirate approximately equally.

Obviously, the additional rib 72 could be formed in a variety of shapes, some of which would be more efficient than others. When cost is a dominant factor in panel design, which is ordinarily the case for grain bins, the best mode configuration shown in FIGS. 5 and 6 provides an effective aspiration result, though theoretically not the most efficient.

Additionally, it is also obvious that many modifications and variations of the present invention are possible in view of the above teachings. It is therefore to be understood that, within the scope of the appended claims, the invention may be practiced otherwise than as specifically described.

I claim:

1. A grain bin having a roof, sidewall and floor wherein the improvement to at least one of said roof, sidewall and floor comprises:

a first aspirating panel with first and second edges opposite one another, a second aspirating panel with first and second edges opposite one another, and means for spacing apart at a fastening joint, in an overlapping relationship, said edge of the first aspirating panel from said first edge of the adjacently positioned second aspiring panel, to form a venturi like opening between the first and second panels, which allows air within the grain bin to be drawn outside the grain bin via an aspirating action, formed by outside air flowing over the panels to create a low pressure region in the vicinity of the venturi like opening.

2. A grain bin having a roof, sidewall and floor wherein the improvement to said roof comprises:

a first aspirating panel with first and second edges opposite one another, a second aspirating panel with first and second edges opposite one another, and means for spacing apart at a fastening joint, in an overlapping relationship, said second edge of the first aspirating panel from said first edge of the adjacently positioned second aspirating panel, to form a venturi like opening between the first and second panels, which allows air within the grain bin to be drawn outside the grain bin via an aspirating action, formed by outside air flowing over the panels to create a low pressure region in the vicinity of the venturi like opening.

3. A grain bin having a roof, sidewall and floor wherein the improvement to said sidewall comprises:

a first aspirating panel with first and second edges opposite one another, a second aspirating panel with first and second edges opposite one another, and means for spacing apart at a fastening joint, in an overlapping relationship, said second edge of the first aspirating panel from said first edge of the adjacently positioned second aspirating panel, to form a venturi like opening between the first and second panels, which allows air within the grain bin to be drawn outside the grain bin via an aspirating action, formed by outside air flowing over the panels to create a low pressure region in the vicinity of the venturi like opening.

4. A grain bin having a roof, sidewall and floor wherein the improvement of said floor comprises:

a first aspirating panel with first and second edges opposite one another, a second aspirating panel with first and second edges opposite one another, means for spacing apart at a fastening joint, in an overlapping relationship, said second edge of the first aspirating panel from said first edge of the adjacently positioned second aspirating panel, to form a venturi like opening between the first and second panels, which allows air within the grain bin to be drawn outside the grain bin via an aspirating action, formed by outside air flowing over the panels to create a low pressure region in the vicinity of the venturi like opening.

5. A grain bin as defined in claim 1, 2, 3, or 4 wherein the improvement further comprises:

a raised rib formed along said second edge of the first aspirating panel, and a raised rib formed along said first edge of the second aspirating panel.

6. A grain bin as defined in claim 1, 2, 3, or 4 wherein the improvement further comprises:

a raised rib formed along said second edge of the first aspirating panel, a raised rib formed along said first edge of the second aspirating panel, and a linearly-extending protrusion on the outer side of said second aspirating panel adjacent to and parallel with said rib.

* * * * *